US007645127B2

(12) United States Patent
Hagen et al.

(10) Patent No.: US 7,645,127 B2
(45) Date of Patent: Jan. 12, 2010

(54) PULSELESS PERISTALTIC PUMP

(75) Inventors: Loren Hagen, 13825 S. Ironwood, Plainfield, IL (US) 60544; Aleksandr P. Koslov, Des Plaines, IL (US)

(73) Assignee: Loren Hagen, Plainfield, IL (US)

( * ) Notice: Subject to any disclaimer, the term of this patent is extended or adjusted under 35 U.S.C. 154(b) by 0 days.

(21) Appl. No.: 11/478,040

(22) Filed: Jun. 29, 2006

(65) Prior Publication Data

US 2006/0245964 A1 Nov. 2, 2006

Related U.S. Application Data

(62) Division of application No. 10/426,062, filed on Apr. 29, 2003, now abandoned.

(51) Int. Cl.
*F04B 43/08* (2006.01)
*F04B 45/06* (2006.01)

(52) U.S. Cl. ..... 417/477.12; 417/477.1; 417/477.9

(58) Field of Classification Search ..... 417/477.3, 417/477.9, 474, 477.12, 477.1
See application file for complete search history.

(56) References Cited

U.S. PATENT DOCUMENTS

| | | | | |
|---|---|---|---|---|
| 3,192,863 | A | 7/1965 | Vadot | |
| 3,358,609 | A | 12/1967 | Worth et al. | |
| 3,565,554 | A | 2/1971 | Muller | |
| 3,724,974 | A | 4/1973 | Molimard | |
| 3,726,613 | A | 4/1973 | Von Casimir | |
| 3,826,593 | A | 7/1974 | Von Casimir | |
| 4,131,399 | A | 12/1978 | Calvet | |
| 4,179,249 | A | 12/1979 | Guttmann | |
| 4,211,519 | A | 7/1980 | Hogan | |
| 4,231,725 | A | 11/1980 | Hogan | |
| 4,519,754 | A | 5/1985 | Minick | |
| 4,552,516 | A | 11/1985 | Stanley | |
| 4,834,630 | A | 5/1989 | Godwin | |
| 4,886,431 | A | 12/1989 | Soderquist et al. | |
| 5,257,917 | A | 11/1993 | Minarik et al. | |
| 5,380,173 | A | 1/1995 | Hellstrom | |
| 5,429,486 | A * | 7/1995 | Schock et al. | 417/476 |
| 5,470,211 | A | 11/1995 | Knott et al. | |
| 5,533,878 | A * | 7/1996 | Iwata | 417/477.3 |
| 6,062,829 | A | 5/2000 | Ognier | |

FOREIGN PATENT DOCUMENTS

| | | |
|---|---|---|
| DE | 94 122 28 | 7/1994 |

* cited by examiner

*Primary Examiner*—Charles G Freay
*Assistant Examiner*—Peter J Bertheaud
(74) *Attorney, Agent, or Firm*—McDonnell Boehnen Hulbert & Berghoff

(57) ABSTRACT

A peristaltic pump comprising a pump housing, a compressible pump tube positioned between rotatable occluding members and a pump tube track in the housing, where there is an opening in the pump tube track between a first occluding member and a second occluding member such that when the second occluding member has exited occlusion of the pump tube at the opening, a third occluding member completes occlusion of the pump tube thus capturing a compensating volume of fluid between the first and third occluding members, and when the second occluding member reenters occlusion at the end of the opening, it displaces the compensating volume towards the outlet of the pump tube, thus maintaining fluid velocity in the outlet stream.

4 Claims, 12 Drawing Sheets

FIG. 1
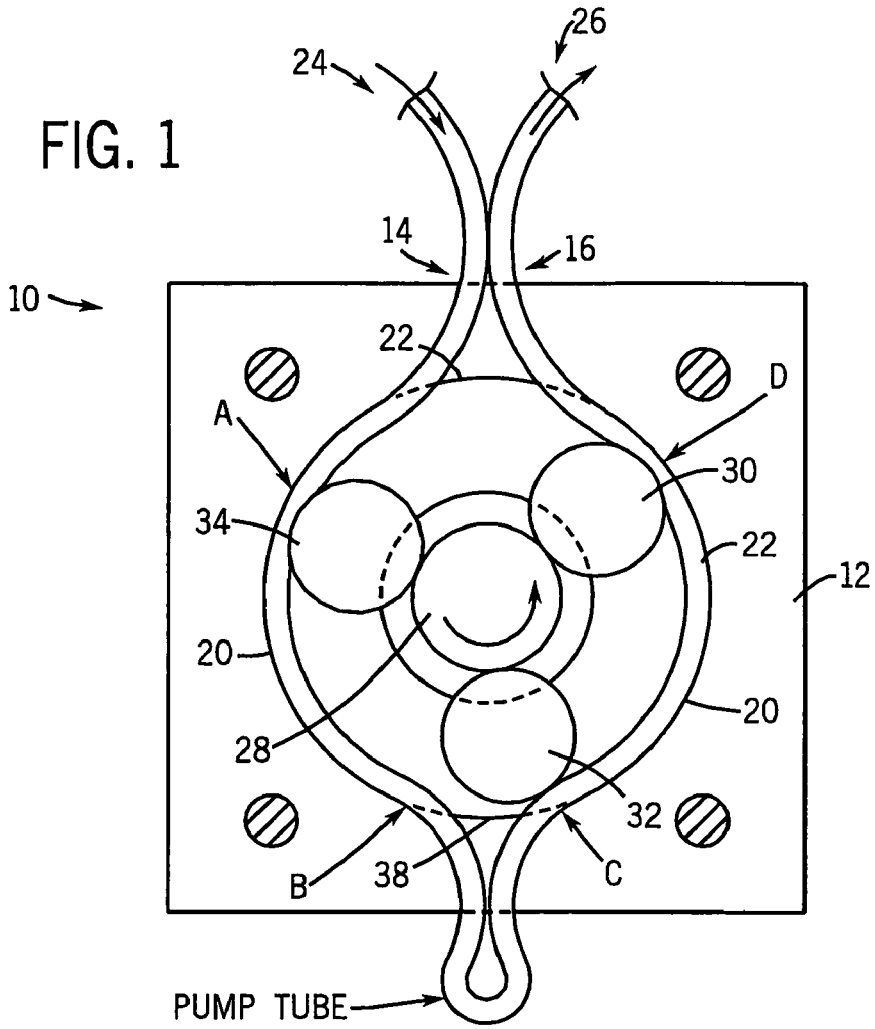
FIG. 2
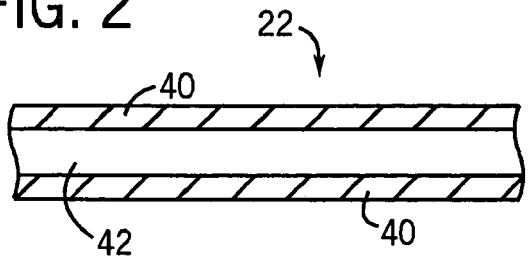
FIG. 3
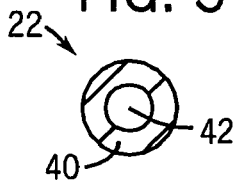
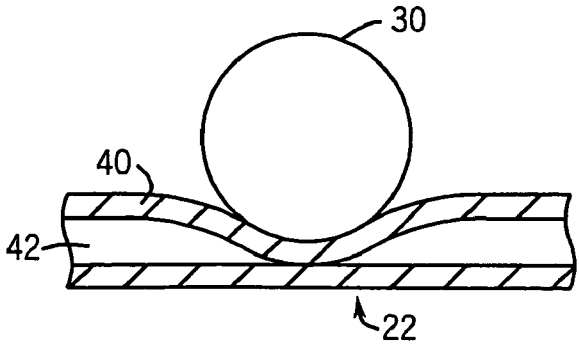
FIG. 4

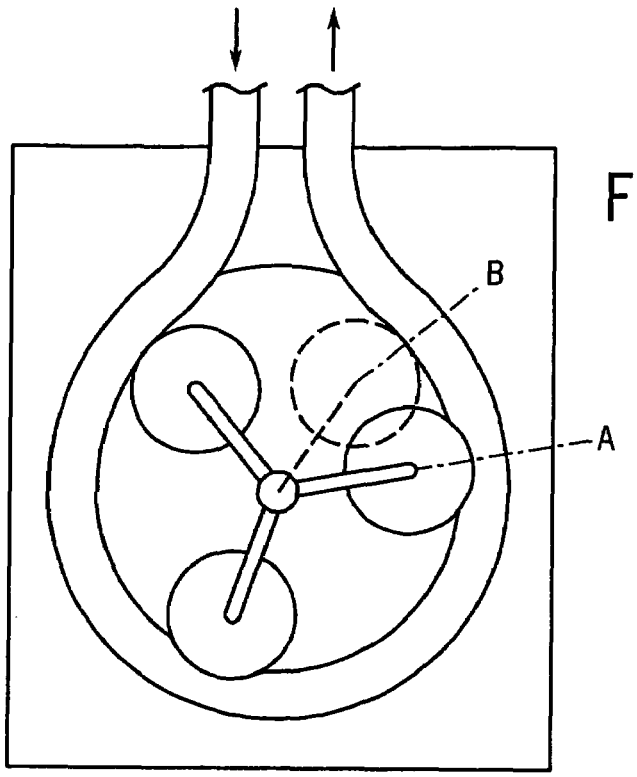
FIG. 17
FIG. 18
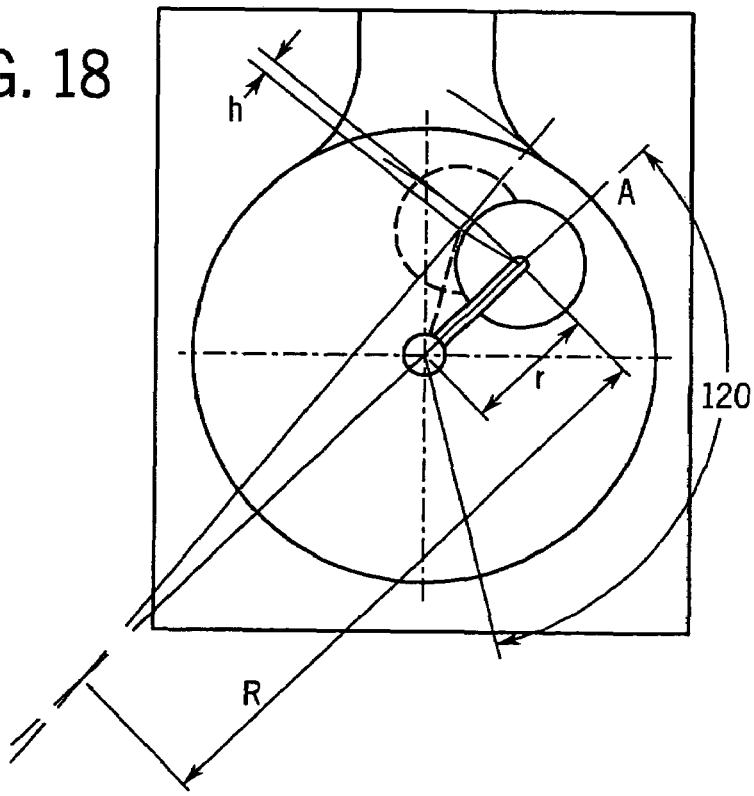

PULSELESS PERISTALTIC PUMP

FIELD OF THE INVENTION

The present invention relates to positive displacement fluid pumps, and more particularly to peristaltic pumps.

BACKGROUND

Peristaltic pumps have been used for a number of years for a wide variety of applications in a wide variety of environments. A peristaltic pump is typically designed to include a pump housing having a compressible pump tube disposed within the pump housing, where the pump tube generally forms a loop having an inlet end and an outlet end. An early version of the peristaltic pump used a straight, rather than round, track. The modern version using a pump tube forming a loop is a much more economically sound design with a smaller physical size and less costly to manufacture. The pump tube is typically filled with a fluid to be delivered by the pump from the inlet end to the outlet end. Fluid is caused to move through the pump tube by mechanical means, typically in the form of rollers, slides, cams, or cam-actuated fingers. In the case of rollers, they are typically driven by rotary means such as an electric motor or mechanically driven shaft. The rollers cause an occlusion of the pump tube by squeezing the pump tube against a wall or track within the pump housing, thereby forcing liquid or gas through the pump tube as the rollers move in a clockwise or counterclockwise direction.

One of the benefits of using a peristaltic pump is that the fluid does not come into contact with the operating environment, except within the pump tube, making the peristaltic pump ideal for medical applications, chemical testing, or other pump applications where it is important to eliminate contact of the fluid with the environment. Furthermore, the mechanical components of the pump do not come into contact with the fluid. As a result, the pump components remain free from contamination from the fluid being pumped. Thus, a peristaltic pump is easy to clean and sterilize because a pump tube may be simply discarded after use, and a new pump tube provided for the next use. In addition, it can be used at a variety of pump speeds, pump tube diameters, and can convey many types of fluids within the pump tube. However, one of the drawbacks associated with the peristaltic pump is that it has not been possible to provide a constant, or pulseless, flow of fluid through the pump tube. Pulses are caused when the rollers or occluding members exit occlusion, that is, when pressure of the roller is removed from the pump tube a vacuum or void is created in the pump tube. As the roller exits occlusion, the pump tube returns to its normal round shape and seeks to draw fluid from the outlet end of the pump tube to fill the void, resulting in a reduction in fluid velocity in the outlet line of the pump tube for the duration of the pulse. The potential for a negative pulse (reduction in fluid velocity) is created when any occluding member occludes the pump tube. This event displaces a specific fluid volume which is determined by the inner diameter of the pump tube, the track diameter, the shape of the occluding member, and to a lesser degree the wall thickness of the pump tube.

The lack of a constant fluid flow caused by pulses in the pump tube render the peristaltic pump unsuitable for certain precision applications. For example, in applications where a small volume of fluid is required, such as where less than a complete revolution of the rotor is used, the effect of the pulses are particularly undesirable. In addition, many sensors used in analytical instruments require a pulseless fluid stream so as to eliminate interference picked up by the sensors that could create an erroneous reading. Pulse dampeners on the pump inlet and/or outlet have been used in some applications. However, these devices work adequately for some applications, but they require a specific volume of liquid and they are very costly, particularly in large peristaltic pumps.

There have been several attempts to reduce the pulses caused when the rollers or occluding members exit occlusion of the pump tube. For example, in U.S. Pat. No. 3,358,609, the pump housing is designed to provide for the roller at the outlet end of the pump to exit occlusion gradually in an effort to minimize the pulsation caused by the rollers. In U.S. Pat. No. 5,470,211, the inlet end of the pump housing has an increasing radius of curvature in the direction of motion of the pump rollers and a continuously decreasing radius of curvature in the direction of motion of the pump at the outlet, where the radii of curvature are greater than the radius of curvature in the area between the inlet and outlet regions of the pump housing to provide a more gradual exiting of occlusion. However, in both the aforementioned patents, the roller directly upstream from the roller exiting occlusion maintains occlusion of the pump tube, continuing to occlude the pump tube, as the roller nearest the outlet end of the pump gradually exits occlusion, and otherwise fails to provide an additional compensating volume of fluid to fill the void. Thus, a vacuum or void continues to exist at the outlet end of the pump tube as the roller at the outlet end of the pump exits occlusion, without a quantity of compensating volume of fluid being provided to fill the void as the roller exits occlusion. In U.S. Pat. No. 3,726,613, a peristaltic pump is disclosed where a cam-controlled pusher is synchronized with the rollers at a location downstream from the rollers. The foregoing pump designs are not advantageous because they require costly manufacturing and/or the use of additional componentry such as a cam in addition to the rollers, or occluding members, and fail to provide a volume of compensating fluid to fill the void as the occluding member exits occlusion, or generally fail to eliminate the undesirable pulses caused when occluding members exit occlusion. Accordingly, there is a need to provide a peristaltic pump that is easy to manufacture, and operates to greatly reduce or eliminate the undesirable pulses caused when the rollers or occluding members exit occlusion.

SUMMARY

The present embodiments serve to greatly reduce or eliminate the pulsation caused when the rollers or occluding members of the pump exit occlusion. The present embodiments operate by transporting to the pump outlet, at the proper time, a volume of compensating fluid to fill the negative pulse or void created as the occluding member exits occlusion of the pump tube. Thus, the present embodiments employ the use of a volume of compensating fluid that is transported to the outlet as the occluding member exits occlusion.

In one exemplary embodiment, the peristaltic pump includes a pump housing having an inlet and an outlet, and a compressible pump tube positioned within the pump housing having a fluid inlet end and a fluid outlet end. The peristaltic pump may include two or more occluding members rotatably mounted within the pump housing, and a pump tube track positioned within the housing, where the pump tube is positioned along the pump tube track between the two or more occluding members and the pump tube track. In this embodiment, the peristaltic pump further includes an opening in the pump tube track between a first occluding member and a second occluding member such that the second occluding member is upstream from the first occluding member, and the second occluding member exits occlusion at a beginning of the opening while the third occluding member enters occlusion and while the first occluding member occludes the pump tube, and reenters occlusion at an end of the opening when the first occluding member exits occlusion. In this embodiment, a length of the pump tube may extend into the opening in the pump tube track to allow the second occluding member to exit and reenter occlusion of the pump tube to provide a volume of compensating fluid that is transported towards the first occluding member when the first occluding member exits occlusion to compensate for the void created at the outlet when the first occluding member exits occlusion. It will be appreciated that filling the void in region D works to maintain the fluid velocity in the outlet stream.

In an alternate embodiment, the peristaltic pump comprises a pump housing having an inlet and an outlet, and a compressible pump tube positioned within the housing having a fluid inlet end and a fluid outlet end, and may have two or more occluding members rotatably mounted within the pump housing, and a pump tube track positioned within the housing. In this embodiment the pump tube is positioned along the pump tube track between the two or more occluding members and the pump tube track, and the outlet end of the pump tube has a constant internal diameter and the inlet end of the pump tube has a variable diameter that is greater than the constant internal diameter of the outlet end of the tube. The peristaltic pump may have a first occluding member and a second occluding member upstream from the first occluding member that occludes the variable diameter end of the pump tube at the inlet end of the tube at the same time the second occluding member is occluding the pump tube. The peristaltic pump operates where when the second occluding member rotates onto the constant diameter portion of the pump tube, the first occluding member continues to occlude the pump tube, such that a greater volume and pressure of fluid is contained within the pump tube between the first and second occluding members than would exist if the entire pump tube were of a constant internal diameter. When first occluding member exits occlusion, a volume of compensating fluid is forced towards the outlet to compensate for the void or negative pulse created when the first occluding member exits occlusion. A single occluding member may be used as well, where the occluding member may occlude both the inlet end and the outlet end of the pump tube simultaneously.

The embodiments also disclose a peristaltic pump comprising a pump housing having an inlet and an outlet, and a compressible pump tube positioned within the pump housing having a fluid inlet end and a fluid outlet end, where two or more occluding members are rotatably mounted within the pump housing, and a pump tube track positioned within the housing, where the pump tube is positioned along the pump tube track between the two or more occluding members and the pump tube track. A portion of the pump tube track includes an extended pump tube length section in the form of a ramped section that extends inwardly or outwardly, or a curved pump tube path to allow for a greater length of pump tube to be placed in that portion of the pump housing, and the occluding members may reticulate radially towards or away from the center of the pump housing when passing over that ramped section or curved section of the pump tube track. In this manner a volume of compensating fluid is forced towards the outlet sufficient to reduce or eliminate the pulse caused by a void created when the first occluding member exits occlusion.

BRIEF DESCRIPTION OF THE DRAWINGS

FIG. 1 illustrates an exemplary peristaltic pump of the present invention;

FIG. 2 illustrates a pump tube having an internal diameter that is not occluded;

FIG. 3 is a cross-sectional view of the pump tube of FIG. 2;

FIG. 4 illustrates a pump tube that has an internal diameter that is occluded by an occluding member and shows the displaced volume;

FIG. 17 illustrates a standard three roller peristaltic pump;

FIG. 18 illustrates the pump tube track geometry as a sector of a conjugate circle;

DETAILED DESCRIPTION OF EXEMPLARY EMBODIMENTS

Figure 5:
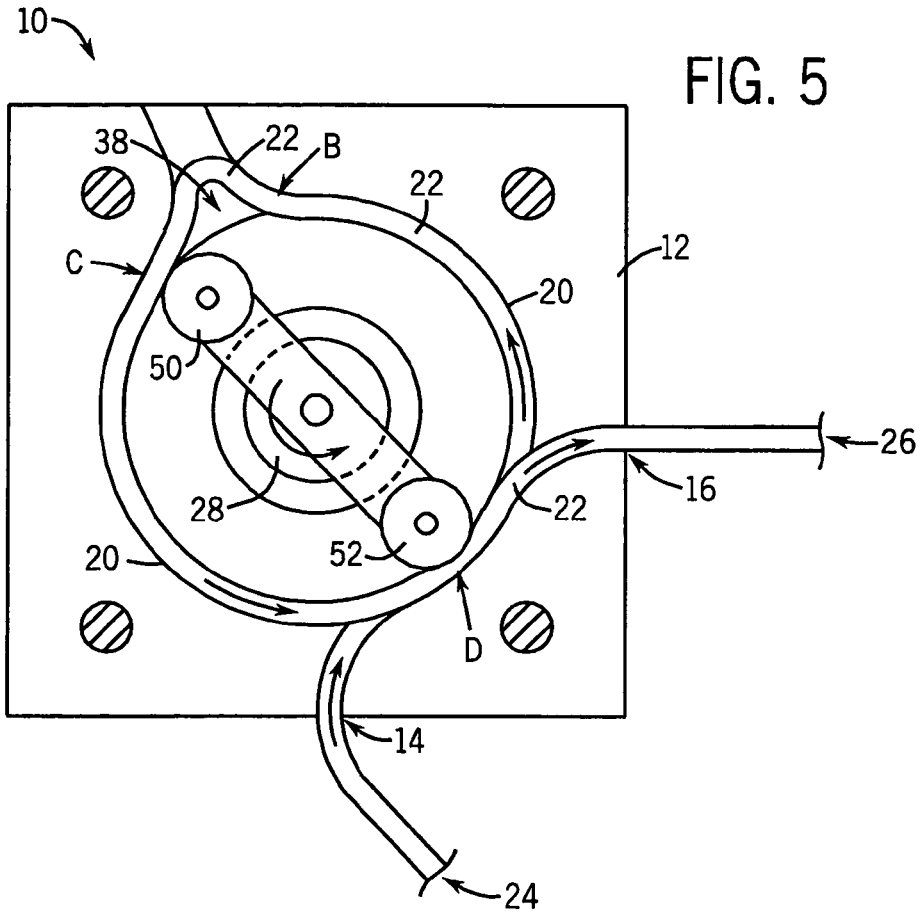
FIG. 5 illustrates a peristaltic pump having two occluding members that simultaneously occlude a pump tube at both the inlet and outlet ends of a pump housing.

As previously described, a peristaltic pump typically includes a pump housing, a pump tube positioned therein along a pump tube track, and one or more occluding members rotatably mounted within the pump housing. Generally, as the occluding member closest to the pump housing outlet exits occlusion of the pump tube, a void is created in the pump tube creating a negative pulse that may actually cause the fluid within the pump tube outlet to reverse direction to fill the void. This phenomenon creates a pulse, or reduction in velocity of the fluid, that will result in an undesirable non-constant flow rate and may be detrimental to the particular peristaltic pump application. The present invention is directed to reducing or eliminating the pulses typically caused in a peristaltic pump when the occluding members exit occlusion. As used herein the term "fluid" shall include gases, liquids, small solids, as well as any combination thereof.

FIG. 1 illustrates an exemplary embodiment of the peristaltic pump 10. Peristaltic pump 10 includes a pump housing 12 that may be formed of two matching halves bolted together and includes an inlet 14 and an outlet 16, although there are many different ways the pump housing may be formed, and the particular type of pump housing selected forms no part of the present invention. The inlet 14 and the outlet 16 can be through the same opening in the pump housing as shown in FIG. 1. Thus, where the claims call for an inlet and an outlet, they do not need to be separate, and a single opening in the pump housing may serve as both. The pump housing 12 may be formed of hard, transparent plastic, although any suitable material may be used. Pump housing 12 may include a pump tube track 20. A pump tube 22 is positioned within the pump housing 12 along the pump tube track 20. The pump tube 22 has an inlet end 24 and an outlet end 26. A rotating mechanism 28 is positioned within the pump housing to rotate occluding members 30, 32, and 34 that are rotatably mounted within the pump housing 12. The rotating members may be rotated using any suitable means for rotating, such as an electric or hydraulic motor or a mechanically driven shaft. In a preferred embodiment an electric motor is used to rotate the occluding members. The pump tube 22 may be made of any suitable compressible material that may be occluded by the occluding members. In a preferred embodiment, the pump tube is made of any number of compressible materials, such as polyurethane, polyvinylchloride, viton, silicone, or santoprene.

Figure 16:
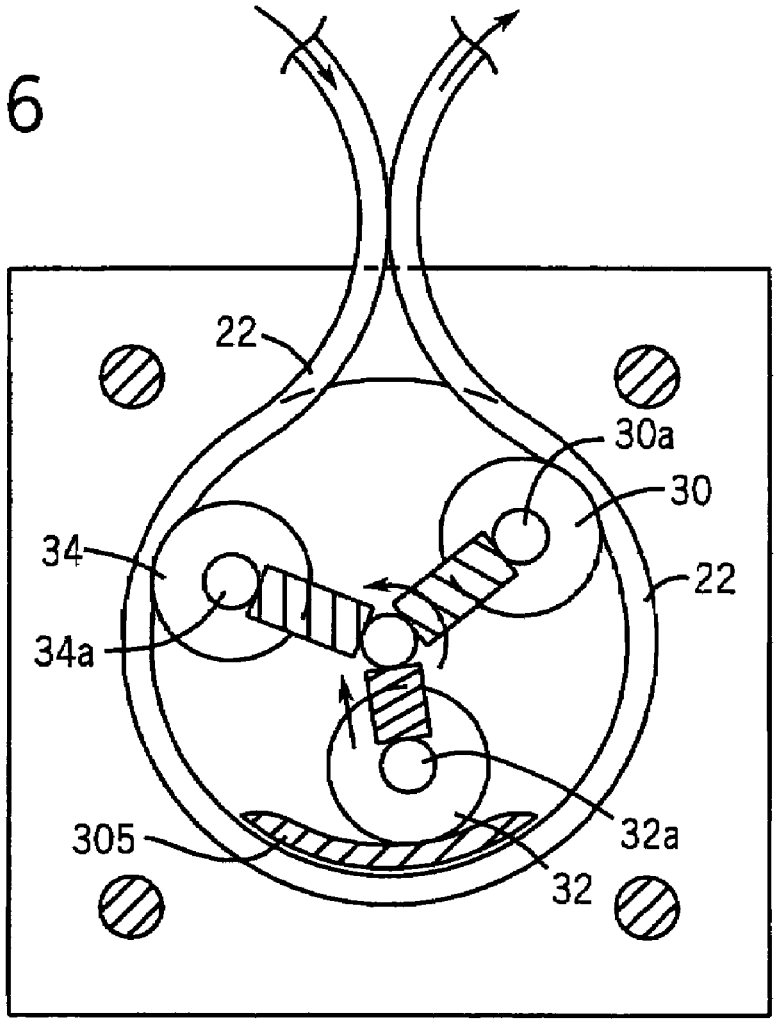
FIG. 16 illustrates a peristaltic pump having a ramped section where the rollers reticulate inwardly when the roller shafts engage the ramped section.

The peristaltic pump operates as follows. As shown in FIG. 1, the rotating mechanism is shown rotating the occluding members 30, 32, and 34 in a counterclockwise direction, although the pump 10 may also operate in a clockwise direction. Fluid is forced through the pump tube 22 in the direction of rotation of the occluding members 30, 32, and 34. Occluding members 30, 32, and 34 may be rollers, cams, slides, cam-actuated fingers or any other means suitable to occlude the pump tube. In a preferred embodiment, the occluding members are rollers. Occluding member 34 is shown occluding the pump tube 22 in region A near the inlet of the pump housing. As shown in FIGS. 2 and 3, the pump tube 22 has an annular wall 40 and an internal diameter 42. Here, the internal diameter is shown as being round, although the internal geometry may take any desirable shape. When occluding member 30 occludes the pump tube 22, the wall 40 is compressed by the occluding member to close off flow through the internal diameter 42 as shown in FIG. 4. As the occluding members rotate within the pump housing, fluid is forced through the pump tube in a direction of rotation of the occluding members. Referring now back to FIG. 1, an opening 38 is shown in the pump tube track 20 beginning in region B and ending in region C of the pump housing 12. Although in FIG. 1 the opening is shown allowing the tube to extend through the pump housing, it will be appreciated that the opening preferably does not allow the tube to extend through the housing and may simply allow the pump tube to extend from the pump tube track. As the occluding members reach the opening 38, they exit occlusion of the pump tube at the beginning of the opening 38 and reenter occlusion at the end of the opening 38. Occluding member 32 is shown just prior to reentering occlusion of the pump tube 22 and occluding member 30 is shown just prior to exiting occlusion of the pump tube 22. The same concept is shown in FIG. 16, where a ramp 305 functions in the same manner as the opening 38 in FIG. 1. The rollers 34, 32, and 30 may be reticulated such that they may ride over the ramp 305 thereby exiting occlusion of the pump tube 22 when they ride up on the ramp and reentering occlusion when they come down from the ramp 305. The ramp may be formed with a groove such that the rollers ride directly on the ramp, or the ramp may designed to allow the roller shafts 34*a*, 32*a*, and 30*a* themselves to ride on the ramp. As used herein, the term "opening" shall include any configuration, including the ramp herein described, that functions to allow the rollers to exit and reenter occlusion along the pump tube track.

Referring now to FIGS. 1 and 2, when occluding member 30 exits occlusion of the pump tube 22, the compression of wall 40 is removed and the internal diameter 42 is returned to its normal round shape. As this happens, a void or negative pulse is created in the pump tube 22 as a result of the opening of the compressed area. To greatly reduce or eliminate the undesirable negative pulse, at the same time that occluding member 30 exits occlusion, occluding member 32 reenters occlusion of pump tube 22 thereby forcing a volume of compensating fluid toward occluding member 30 to fill the void. Preferably, the geometry of pump tube track 20 in region C and the geometry of pump tube track 20 in region D are such that when occluding member 32 begins reentering occlusion occluding member 30 begins exiting occlusion and the occluding member 30 completely exits occlusion at the moment occluding member 32 completely enters occlusion. In this manner, the occluding member 32 forces a volume of compensating fluid to fill the void created when occluding member 30 exits occlusion to greatly reduce or eliminate the negative pulse that would otherwise be created. It will be appreciated that the compensating fluid may be generated instantaneously or over a longer time period by changing the track geometry, and this invention is not limited to generating the compensating fluid instantaneously or to a particular track geometry. It will also be appreciated that filling the void in region D works to maintain the fluid velocity in the outlet stream. While FIG. 1 discloses the use of three occluding members, it will be appreciated that the pump housing could use four, five, six, or even potentially limitless number of occluding members, and the invention is in no way limited to the use of three occluding members.

Figure 19A:
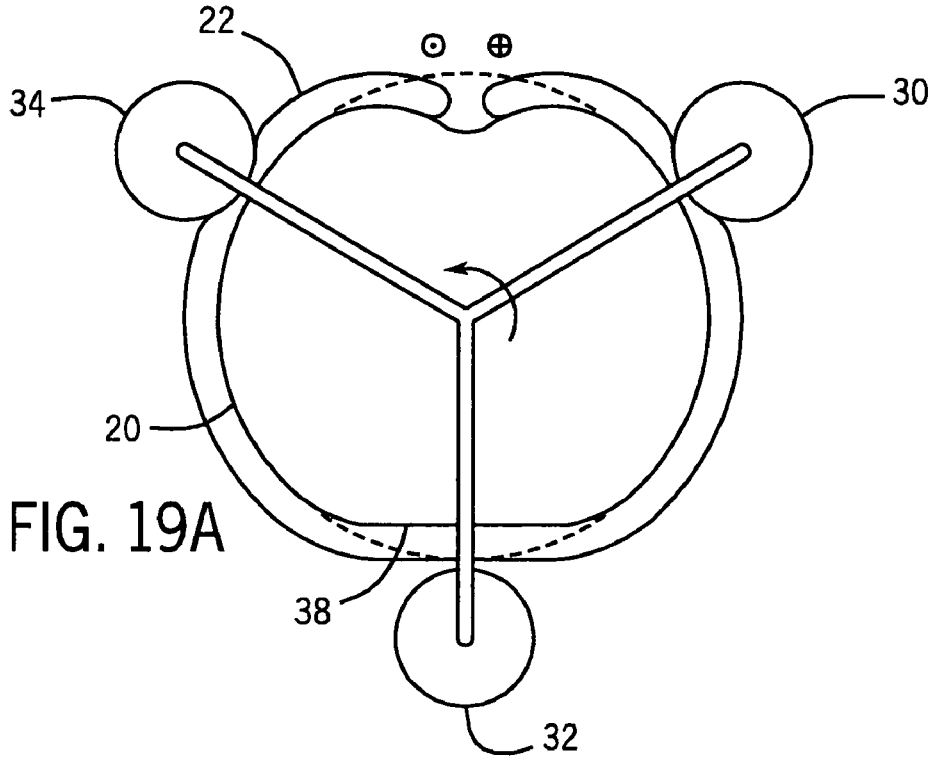
FIGS. 19*a-b* illustrates a peristaltic pump where the rollers are positioned radially outwardly from the pump tube.
Figure 19B:
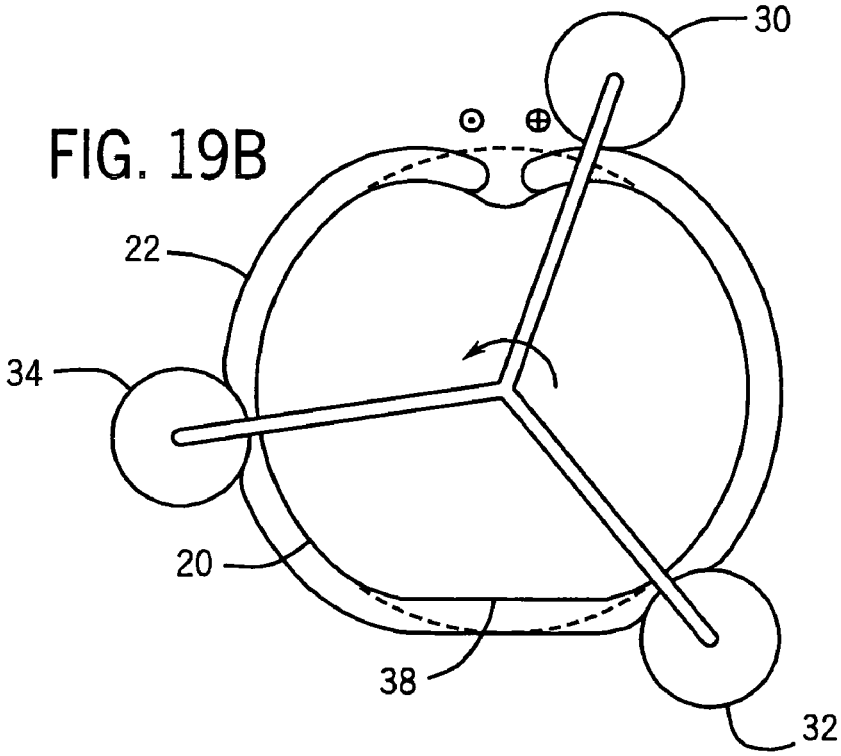

Moreover, FIG. 1 discloses the pump tube positioned radially outwardly from the rollers. However, the same concepts shown in FIG. 1 could be employed where the pump tube is positioned radially inwardly from the rollers as shown in FIG. 19*a-b*. Just as in FIG. 1, the pump tube track 20 includes a flat area 38, or opening, such that when the rollers pass over flat area 38 they exit occlusion of the pump tube 22 and reenter occlusion at the end of the flat area 38 as shown in FIG. 19*b*. In fact, having the rollers 34, 32, 30 positioned radially outwardly from the pump tube 22 provides an advantage of having the pump tube 22 easily conform to the pump tube track 20. Where the pump tube is positioned radially outwardly from the rollers, the pump tube has a tendency to pull away from the pump tube track and to conform to the rollers, necessitating in some instances the use of a pump tube with a dovetail or tang to properly position and hold captive the pump tube along the pump tube track (see FIG. 15).

An example of the typical flow rate variation for a regular 3-roller peristaltic pump at 60 rpm is shown in Table I below. There are two components in this flow curve. First there is a flow rate constant, and secondly, there are three (3) pulses, which cause the flow rate, i.e., velocity variation. The constant flow rate takes place when the tube is completely occluded by a roller traveling in either a clockwise or counterclockwise direction along the track. The constant component of the flow rate can be estimated as follows—see formula No. 1 where $d=D-d_{out}$, $S=\pi d_{in}^2/4$. Here D is the pump body track diameter, $d_{out}$ and $d_{in}$ are the outside and inside diameters of the tube, N is the rotor revolution per time period, and ρ is liquid density.

$$F_c=\pi dN\rho S, \qquad \text{Formula No. 1}$$

Figure 23:
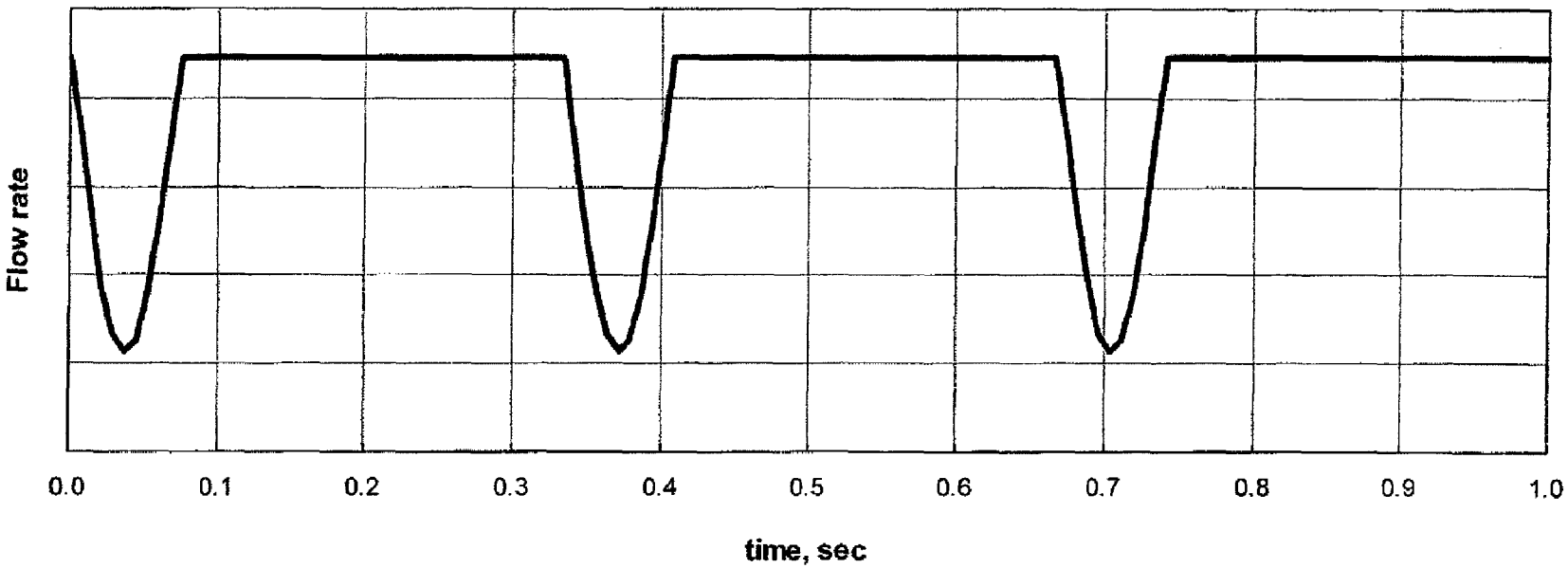
FIG. 23 is a table showing the typical flow rate variation for a 3 roller pump at 60 rpm.

The flow rate pulse, shown in in FIG. 23, for a 3 roller pump at 60 rpm is best understood with respect to a standard three 20 roller peristaltic pump shown in FIG. 17. At the roller position A, the track radius begins to increase and roller #1 staffs to exit occlusion thus allowing the tube to open. The flow rate pulse is completed at the roller position B when roller #1 has completely exited occlusion (the tube is completely open). The pulse amplitude and shape depend on the roller diameter, track diameter (radius), tube inside diameter, and tube deformation characteristics. Tube deformation is dependent on the pump tube material, wall thickness, roller velocity along the track, and occlusion force. Depending on these parameters, the flow rate during the pulse may be negative. This means that the liquid can flow in the reverse direction with respect to the roller direction along the track. The greatest problem in calculating the pulse shape is to estimate the actual tube deformation geometry. The formula used to calculate the pulse duration ($t_{pulse}$) is shown below:

$$t_{pulse}=\{\arccos[b/(R-r)]+\arccos[a/r]\}/(360N),$$

where: $b=R-h-a$, and $a=0.5[(R-h)^2+2Rr-R^2]/(R-h)$. Here R is the distance from the center of the conjugate circle to the roller center at roller position A (see FIG. 18), r is the roller arm diameter, and h is the tube deformation characteristic; i.e., the geometry the pump tube assumes during occlusion. In some cases it is possible that the peristaltic pump flow rate variation may contain no constant component and the pulse duration and shape may be substantially different from the theoretical estimations because of the tube deformation characteristics.

FIG. 5 discloses a peristaltic pump 10 that uses the same concept as the peristaltic pump shown in FIG. 1, except it has only two occluding members. Therefore, the same numerals will be used as were used in FIG. 1 where appropriate. Peristaltic pump 10 includes a pump housing 12 that includes an inlet 14 and an outlet 16. Pump housing 12 may include a pump tube track 20. A pump tube 22 is positioned within the pump housing 12 along the pump tube track 20. The pump tube 22 has an inlet end 24 and an outlet end 26. A rotating mechanism 28 is positioned within the pump housing to rotate occluding members 50 and 52 that are rotatably mounted within the pump housing 12.

The peristaltic pump of FIG. 5 operates as follows. As shown in FIG. 5, the rotating mechanism is shown rotating the occluding members 50 and 52 in a counterclockwise direction. Fluid is forced through the pump tube 22 in the direction of rotation of the occluding members 50 and 52, which are preferably rollers on small pumps. The pump housing has an occluding region D positioned between the inlet 14 and the outlet 16 of the pump housing. The inlet end 24 and the outlet end 26 of the pump tube 22 are positioned next to one another along the pump tube track 20 in occluding region D such that both ends are being occluded simultaneously. Occluding member 52 is shown occluding both the inlet end 24 and the outlet end 26 of the pump tube 22, i.e., simultaneously, in occluding region D of the pump housing 12. As the occluding members 50 and 52 rotate within the pump housing, fluid is forced through the pump tube 22 in a direction of rotation of the occluding members. An opening 38 is shown in the pump tube track 20 beginning in region B and ending in region C of the pump housing 12. As the occluding members reach the opening 38, they exit occlusion of the pump tube at the beginning of the opening 38 and reenter occlusion at the end of the opening 38. Occluding member 50 is shown just prior to reentering occlusion of the pump tube 22 and occluding member 52 is shown just prior to exiting occlusion of the outlet end 26 of pump tube 22.

When occluding member 52 exits occlusion of the outlet end 26 of pump tube 22, a void or negative pulse is created in the pump tube 22. To greatly reduce or eliminate the undesirable negative pulse, at the same time that occluding member 52 exits occlusion of the outlet end 26 of the pump tube 22, occluding member 50 reenters occlusion of pump tube 22 thereby forcing a volume of compensating fluid toward the outlet to fill the void. Preferably, the geometry of pump tube track 20 in region C and the geometry of pump tube track 20 in region D are such that when occluding member 50 begins reentering occlusion occluding member 52 begins exiting occlusion of the outlet end 26, and the occluding member 52 completely exits occlusion at the moment occluding member 50 completely enters occlusion. In this manner, the occluding member 50 forces a volume of compensating fluid to fill the void created when occluding member 52 exits occlusion of the outlet end 26 of the pump tube 22 to greatly reduce or eliminate the negative pulse that would otherwise be created. It will be appreciated that the compensating fluid may be generated instantaneously or over a longer time period by changing the track geometry, and this invention is not limited to generating the compensating fluid instantaneously or to a particular track geometry.

Figure 6:
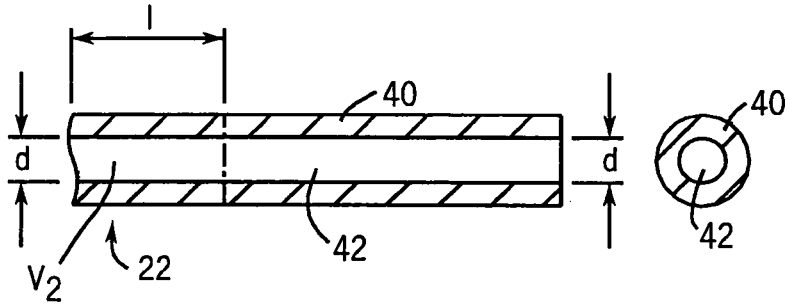
FIG. 6 illustrates an outlet end of a pump tube having a constant internal diameter.
Figure 7:
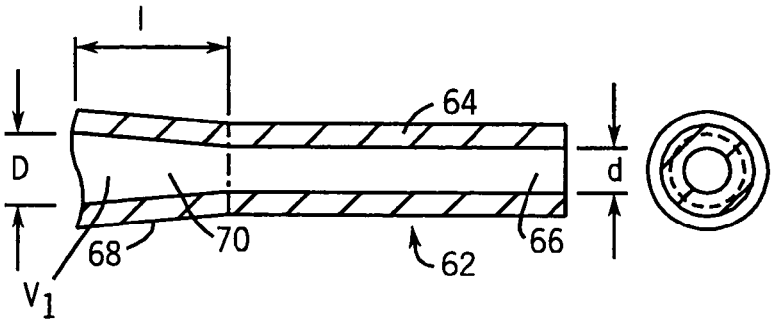
FIG. 7 illustrates an inlet end of a pump tube having a variable internal diameter that is greater than the internal diameter of the outlet end of the pump tube.
Figure 8:
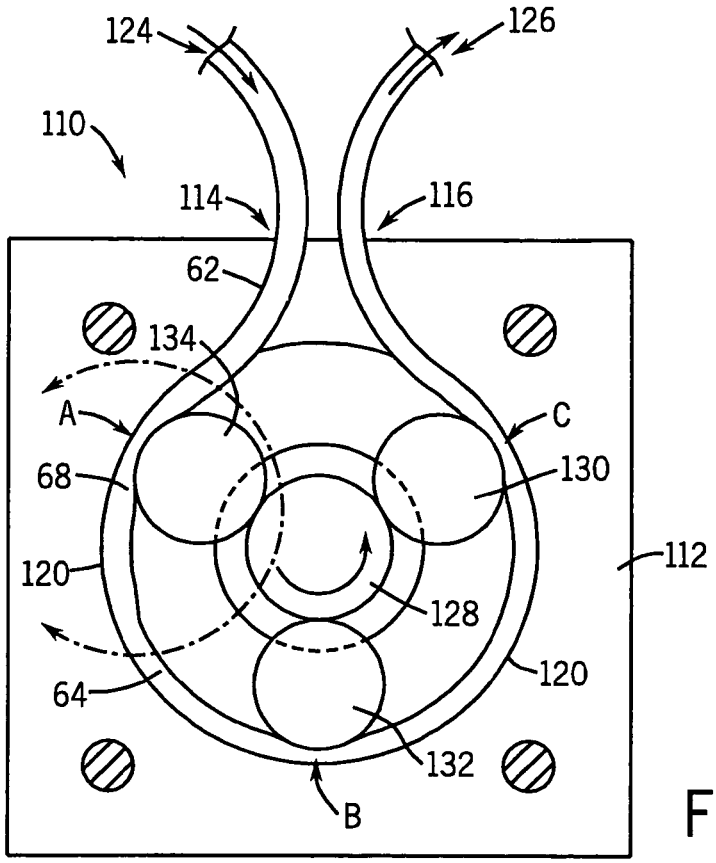
FIG. 8 illustrates a peristaltic pump using the pump tube shown in FIG. 7.

FIG. 6 discloses a pump tube 22 having an annular wall 40 and constant internal diameter 42. FIG. 7 discloses a pump tube 62 having an outlet end portion 64 having a constant internal diameter 66 and an inlet end portion 68 having a variable internal diameter 70 that is greater than the internal diameter 66. FIG. 8 shows a peristaltic pump 110 using -a pump tube 62 of the type shown in FIG. 7. Peristaltic pump 110 includes a pump housing 112 that includes an inlet 114 and an outlet 116. Pump housing 112 may include a pump tube track 120. A pump tube 62 is positioned within the pump housing 112 along the pump tube track 120. The pump tube 62 has an inlet end 124 and an outlet end 126. A rotating mechanism 128 is positioned within the pump housing to rotate occluding members 130, 132, and 134 that are rotatably mounted within the pump housing 112. This design does not require the tube to be held captive along the track. Referring back to FIGS. 6 and 7, the displaced volume inside the tube, or compensating volume, can be calculated according to the following formula:

$$\pi/12l(D^2+Dd-2d^2)=V_{dis}(\text{compensating volume}),$$

where $$l=12V_{dis}/\pi(D^2+Dd-2d^2)$$

As shown in FIGS. 6 and 7, D is the inner diameter of the pump tube at the beginning of the increased diameter portion of the pump tube, and d is the inner diameter of the pump tube at the end of the increased diameter of the pump tube, as well as the standard inner diameter of the pump tube. As shown in FIG. 6, the diameter of the pump tube tapers down from inner diameter D to inner diameter d along length l. Thus, the volume of fluid within the variable inner diameter pump tube along length l is $V_1$, whereas the volume of fluid within the same length of tube l having a standard inner diameter d is $V_2$. Of course, it will be appreciated that this is a general formula and certain parameters can only be determined by physical testing, such as the tube deformation characteristics, the tube material, the roller diameter, and possibly roller velocity.

Figure 9:
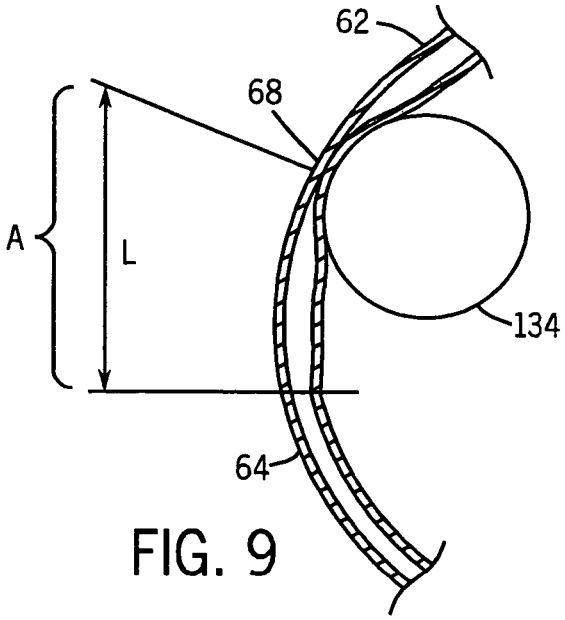
FIG. 9 illustrates a close-up view of the pump tube shown in FIG. 8.

The peristaltic pump 110 of FIG. 8 operates as follows. As shown in FIG. 8, the rotating mechanism is shown rotating the occluding members 130, 132, and 134 in a counterclockwise direction. Fluid is forced through the pump tube 62 in the direction of rotation of the occluding members 130, 132, and 134. The pump housing has an occluding region A positioned near the inlet 114 of the pump housing 112, an occluding region B downstream from region A, and an occluding region C near the outlet 116 of the pump housing 112. The variable diameter portion 68 of pump tube 62 is positioned in region A of the pump housing 112. Variable diameter portion 68 is positioned within the pump housing such that full occlusion of the pump tube 62 by occluding member 134 occurs before the occluding member reaches the constant diameter portion 64 of the pump tube 62. A cutaway view of Region A of FIG. 8 is shown in FIG. 9, where occluding member 134 fully occludes the pump tube 62 in the variable diameter portion 68 of the pump tube 62 before it reaches the constant diameter portion 64 of the pump tube 62. Referring back now to FIG. 8, as the occluding member 134 rotates onto the constant diameter portion 64 of the pump tube 62 and towards occluding member 132, a greater volume and pressure of fluid is contained within the pump tube 62 between occluding members 134 and 132 than if the pump tube had a constant internal diameter throughout. The same is true of the fluid contained within the pump tube 62 between occluding members 132 and 130.

As occluding member 130 exits occlusion of the pump tube 62 near the outlet 116 of the pump housing 112, a void or negative pulse is created in the pump tube 62. However, because there is a greater volume and pressure of fluid between occluding members 132 and 130, as occluding member 130 exits occlusion of the pump tube, a volume of compensating fluid is forced toward the outlet to fill the void. The use of the variable diameter portion 68 of pump tube 62 provides a compensating volume of fluid to fill the void and greatly reduces or eliminates the undesirable negative pulse that would otherwise be created when the occluding member 130 exits occlusion. While FIG. 8 discloses the use of three occluding members, it will be appreciated that the pump housing could use four, five, six, or even potentially limitless number of occluding members, and the invention is in no way limited to the use of three occluding members.

Figure 10:
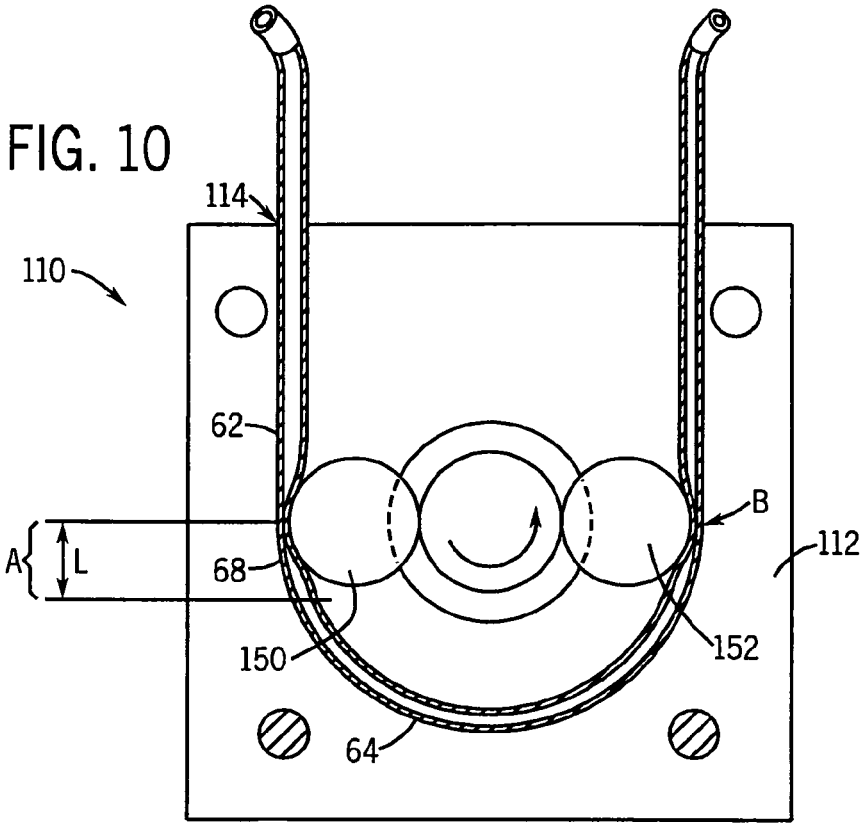
FIG. 10 illustrates an embodiment of a peristaltic pump using the pump tube shown in FIG. 7.

FIG. 10 discloses a peristaltic pump using the same concept as the peristaltic pump in FIG. 8, except that it uses only two occluding members. As shown in FIG. 10, The pump housing has an occluding region A positioned near the inlet 114 of the pump housing 112, and an occluding region B positioned near the outlet 116 and downstream from region A. As in FIG. 8, the variable diameter portion 68 of pump tube 62 is positioned in region A of the pump housing 112. Variable diameter portion 68 is positioned within the pump housing such that full occlusion of the pump tube 62 by occluding member 150 occurs before the occluding member reaches the constant diameter portion 64 of the pump tube 62. As the occluding member 150 rotates onto the constant diameter portion 64 of the pump tube 62 and towards occluding member 152, a greater volume and pressure of fluid is contained within the pump tube 62 between occluding members 150 and 152 than if the pump tube had a constant internal diameter throughout.

As occluding member 130 exits occlusion of the pump tube 62 in region B of the pump housing 112, a void or negative pulse is created in the pump tube 62. However, because there is a greater volume and pressure of fluid between occluding members 150 and 152, as occluding member 152 exits occlusion of the pump tube, a volume of compensating fluid is forced toward the outlet to fill the void. The use of the variable diameter portion 68 of pump tube 62 provides a compensating volume of fluid to fill the void and greatly reduces or eliminates the undesirable negative pulse that would otherwise be created when the occluding member 152 exits occlusion.

Figure 11:
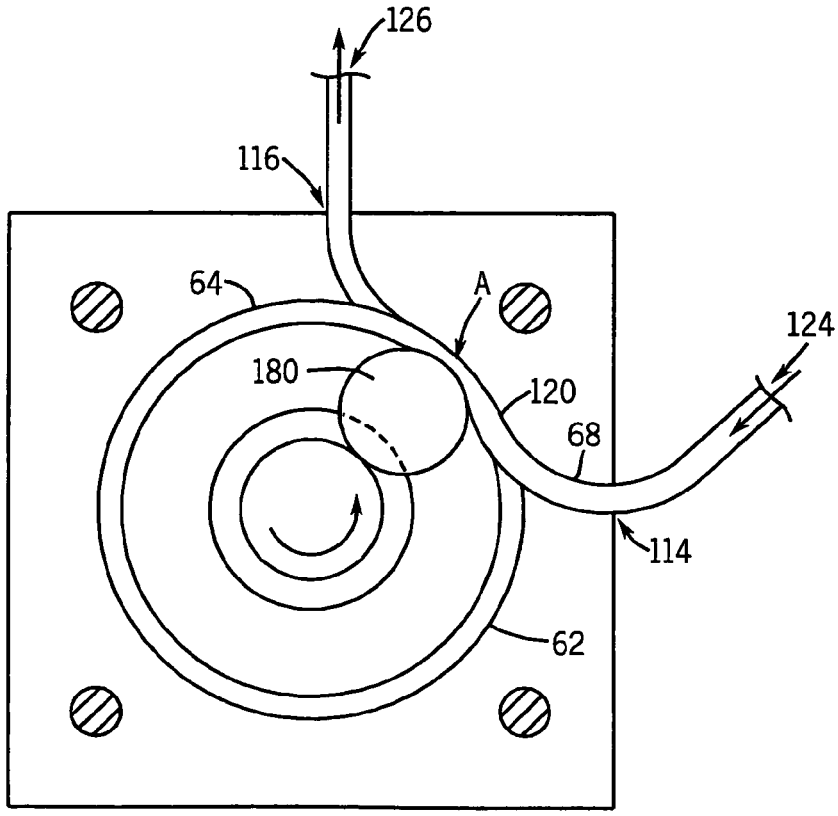
FIG. 11 illustrates a peristaltic pump using the pump tube shown in FIG. 7.

FIG. 11 discloses a peristaltic pump using the same concept as the peristaltic pump in FIGS. 8 and 10, except that it uses only a single occluding member. As shown in FIG. 11, the pump housing has an occluding region A positioned between the inlet 114 and the outlet 116 of the pump housing 112. The inlet end 124 and the outlet end 126 of the pump tube 62 are positioned next to one another along the pump tube track 120 in occluding region A, i.e., they are occluded simultaneously. Occluding member 180 is shown occluding both the inlet end 124 and the outlet end 126 of the pump tube 62, i.e., simultaneously, in occluding region A. Thus, occlusion of both the inlet end 124 and outlet end 126 of the pump tube 62 by occluding member 180 can occur. The variable diameter portion 68 of pump tube 62 is positioned in region A of the pump housing 112. Variable diameter portion 68 is positioned within the pump housing such that full occlusion of the pump tube 62 by occluding member 180 occurs before the occluding member 180 reaches the constant diameter portion 64 of the pump tube 62, and the occluding member 180 rotates onto the constant diameter portion 64 of the pump tube 62 before the occluding member 180 exits occlusion of the outlet end 126 of the pump tube 62. As the occluding member 180 rotates onto the constant diameter portion 64 of the pump tube 62, a greater volume and pressure of fluid is contained within the pump tube 62 than if the pump tube had a constant internal diameter throughout.

As occluding member 180 exits occlusion of the outlet end 126 of pump tube 62 in region A of the pump housing 112, a void or negative pulse is created in the pump tube 62. However, because there is a greater volume and pressure of fluid within the pump tube, as occluding member 180 exits occlusion of the pump tube 62 at the outlet end 126, a volume of compensating fluid is forced toward the outlet end 126 into the outlet line to fill the void.

Figure 12:
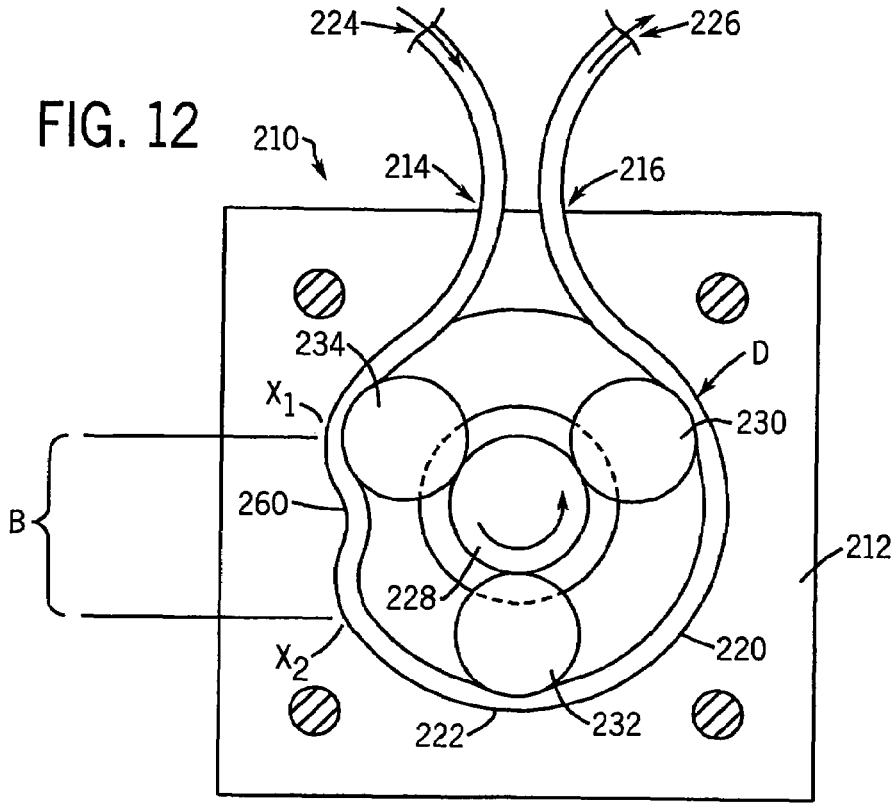
FIG. 12 illustrates an alternate embodiment of a peristaltic pump of the present invention.

FIG. 12 discloses an alternate embodiment of the invention using a concept similar to that shown in FIGS. 7-11. In FIG. 12, a peristaltic pump 210 includes a pump housing 212 that includes an inlet 214 and an outlet 216. Pump housing 212 may include a pump tube track 220. A pump tube 222 is positioned within the pump housing 212 along the pump tube track 220. The pump tube 222 has an inlet end 224 and an outlet end 226. A rotating mechanism 228 is positioned within the pump housing to rotate occluding members 230, 232, and 234 that are rotatably mounted within the pump housing 212.

Figure 15:
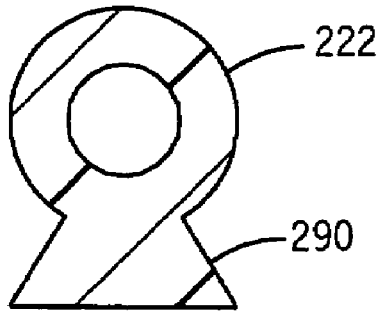
FIG. 15 is a cutaway view of a pump tube having a tang to properly position and hold captive the pump tube along the pump tube track.

As shown in FIG. 12, the rotating mechanism is shown moving the occluding members 230, 232, and 234 in a counterclockwise direction. Fluid is forced through the pump tube 222 in the direction of rotation of the occluding members 230, 232, and 234. The pump housing has an occluding region D positioned near the outlet 216 of the pump housing 212. The pump tube track 220 has an extended pump tube length section in the form of an inwardly ramped section 260 that extends towards the center of the pump housing 212 in a region B shown positioned between occluding member 234 and occluding member 232. The pump tube 222 extends across the ramped section 260. Ideally, the pump tube includes a dovetail or tang along its length as shown in FIG. 15. The tang 290 on the pump tube 222 is designed to be positioned within the pump tube track 220 to hold the pump tube 222 in place. As the occluding members rotate, they ride along the ramped section 260 by reticulating inwardly towards the center of the pump housing 212 as they pass over the ramped section 260. The occluding members continue to occlude the pump tube 222 while traversing over the ramped section 260. Reticulation of the occluding members may be accomplished by any suitable means to allow them to pass over the ramped section and continue to occlude the pump tube 222. In a preferred embodiment, the reticulation is accomplished by using spring-biased rollers. As will be appreciated, because of the ramped section 260, there is a greater length of tube between occluding members 234 and 232 than between occluding members 232 and 230. Consequently a greater volume and pressure of fluid is contained within the pump tube 222 between occluding members 232 and 230 because the pump tube 222 must accommodate all of the fluid contained within the greater length section of tube where ramped section 260 is positioned between occluding members 234 and 232. As occluding member 230 exits occlusion of the pump tube 222 near the outlet 216 of the pump housing 212, a void or negative pulse is created in the pump tube 222. However, because there is a greater volume and pressure of fluid between occluding members 232 and 230 than would exist in the absence of ramped section 260, as occluding member 230 exits occlusion of the pump tube, a volume of compensating fluid is forced toward the outlet end to fill the void. The use of the ramped section 260 provides a compensating volume of fluid to fill the void and greatly reduces or eliminates the undesirable negative pulse that would otherwise be created when the occluding member 230 exits occlusion. While FIG. 12 discloses the use of three occluding members, it will be appreciated that the pump housing could use four, five, six, or even potentially limitless number of occluding members, and the invention is in no way limited to the use of three occluding members.

Figure 14:
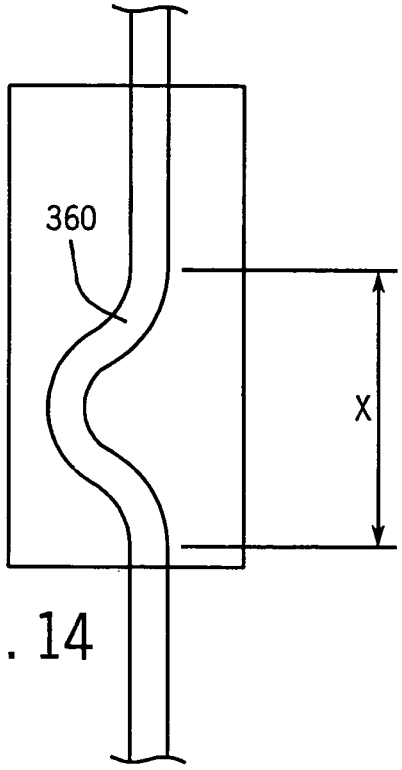
FIG. 14 illustrates an extended pump tube track section in the form of a lateral curve of the pump tube track.
Figure 13:
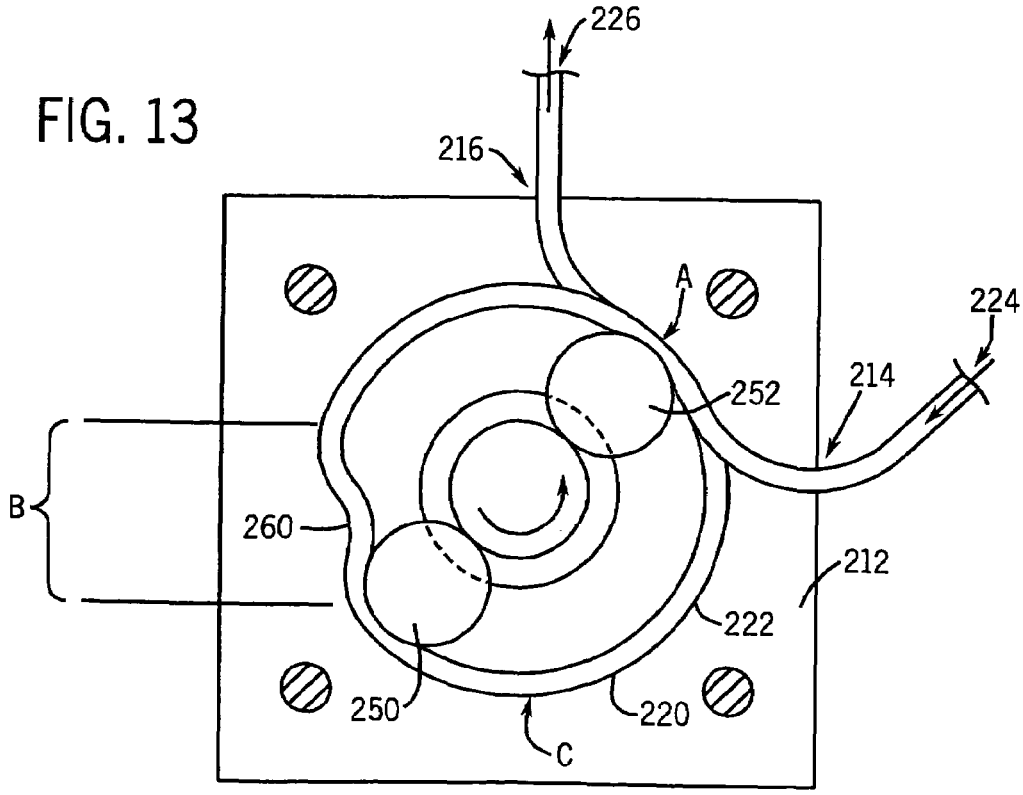
FIG. 13 illustrates a peristaltic pump using the concepts shown in FIG. 12.

FIG. 13 discloses a peristaltic pump using the same concept as the peristaltic pump in FIG. 12, except that it uses only two occluding members. As shown in FIG. 13, the pump housing has an occluding region A positioned between the inlet 214 and the outlet 216. The inlet end 224 and the outlet end 226 of the pump tube 222 are positioned next to one another along the pump tube track 220 in occluding region A. Occluding member 252 is shown occluding both the inlet end 224 and the outlet end 226 of the pump tube 222 in occluding region A. Thus, occlusion of both the inlet end 224 and outlet end 226 by occluding member 252 can occur. The pump tube track 220 has an inwardly ramped section 260 that extends towards the center of the pump housing 212 in a region B shown positioned between occluding member 252 and occluding member 250. The pump tube 222 extends across the ramped section 260. As the occluding members rotate, they ride along the ramped section 260 by reticulating inwardly towards the center of the pump housing 212 as they pass over the ramped section 260. The occluding members continue to occlude the pump tube 222 while traversing over the ramped section 260. As will be appreciated, because of the ramped section 260, there is a greater length of tube between occluding members 252 and 250 in region C. Consequently a greater volume and pressure of fluid is contained within the pump tube 222 in region C between occluding members 252 and 250 because the pump tube 222 must accommodate all of the fluid contained within the greater length section of tube where ramped section 260 is positioned in region B. As occluding member 230 exits occlusion of the outlet end 226 of pump tube 222 near the outlet 216 of the pump housing 212, a void or negative pulse is created in the pump tube 222. However, because there is a greater volume and pressure of fluid between occluding members 252 and 250 in region B than would exist in the absence of ramped section 260, as occluding member 230 exits occlusion of the outlet end 226 of the pump tube, a volume of compensating fluid is forced toward the outlet end to fill the void. The use of the ramped section 260 provides a compensating volume of fluid to fill the void and greatly reduces or eliminates the undesirable negative pulse that would otherwise be created when the occluding member 252 exits occlusion. It will be appreciated that the ramped section 260 is shown as being inwardly sloped towards the center of the pump housing, but could also be sloped outwardly to achieve the same result by using spring-biased rollers that can reticulate outwardly. In addition, the extended pump tube length section could be provided in the form of a lateral curve of the pump tube within the pump tube track as shown in FIG. 14 below. Thus, the term "extended pump tube length section" is meant to encompass both inwardly and outwardly sloped pump tube tracks, as well as those providing for a lateral curve of the pump tube. FIG. 14 uses the same concepts disclosed in FIGS. 12-13, except the peristaltic pump includes an extended pump tube length section 360 in the form of a laterally curved pump tube track to provide for a curving of the pump tube to increase the length of tubing in region B of FIG. 13 or region B of FIG. 12.

In FIGS. 12-14, the pump tube having the tang 290 shown in FIG. 15 is preferably used to maintain and hold captive the pump tube in a proper position along the pump tube track. In each of FIGS. 12-14, the concept of providing an increased length of tube between the occluding members is shown to provide for an increased volume of fluid within the pump tube.

It will be appreciated that each of the concepts set forth in FIGS. 1-16 discloses the pump tube positioned radially outwardly from the rollers. However, the same concepts shown in FIGS. 1-16 could be employed where the pump tube is positioned radially inwardly from the rollers as shown in FIGS. 19*a-b*. The pump tube track 20 includes a flat area 38, or opening, such that when the rollers pass over opening 38 they exit occlusion of the pump tube 22 and reenter occlusion at the end of the opening 38 as shown in FIG. 19*b*. In fact, having the rollers 34, 32, 30 positioned radially outwardly from the pump tube 22 provides an advantage of having the pump tube 22 easily conform to the pump tube track 20. Where the pump tube is positioned radially outwardly from the rollers, the pump tube has a tendency to pull away from the pump tube track and to conform to the rollers, necessitating in some instances the use of a pump tube with a dovetail or tang to properly position and hold captive the pump tube along the pump tube track.

In addition, in FIGS. 1 and 5, an opening 38 in the pump tube track 20 is shown extending radially outwardly from the pump housing. However, in the case where the pump tube is positioned radially inwardly from the rollers, the opening could extend radially inwardly towards the middle of the pump housing such that, as shown in FIGS. 19*a* and 19*b*, the occluding members pass over the opening 38 in the pump tube track 20 thereby exit occlusion at the beginning of the opening 38 and reenter occlusion of the pump tube at the end of the opening 38. Therefore, as used herein the term "opening" is meant to encompass both types of openings in the pump tube track, that is, a portion of the track that extends either radially outwardly or radially inwardly.

Figure 20:
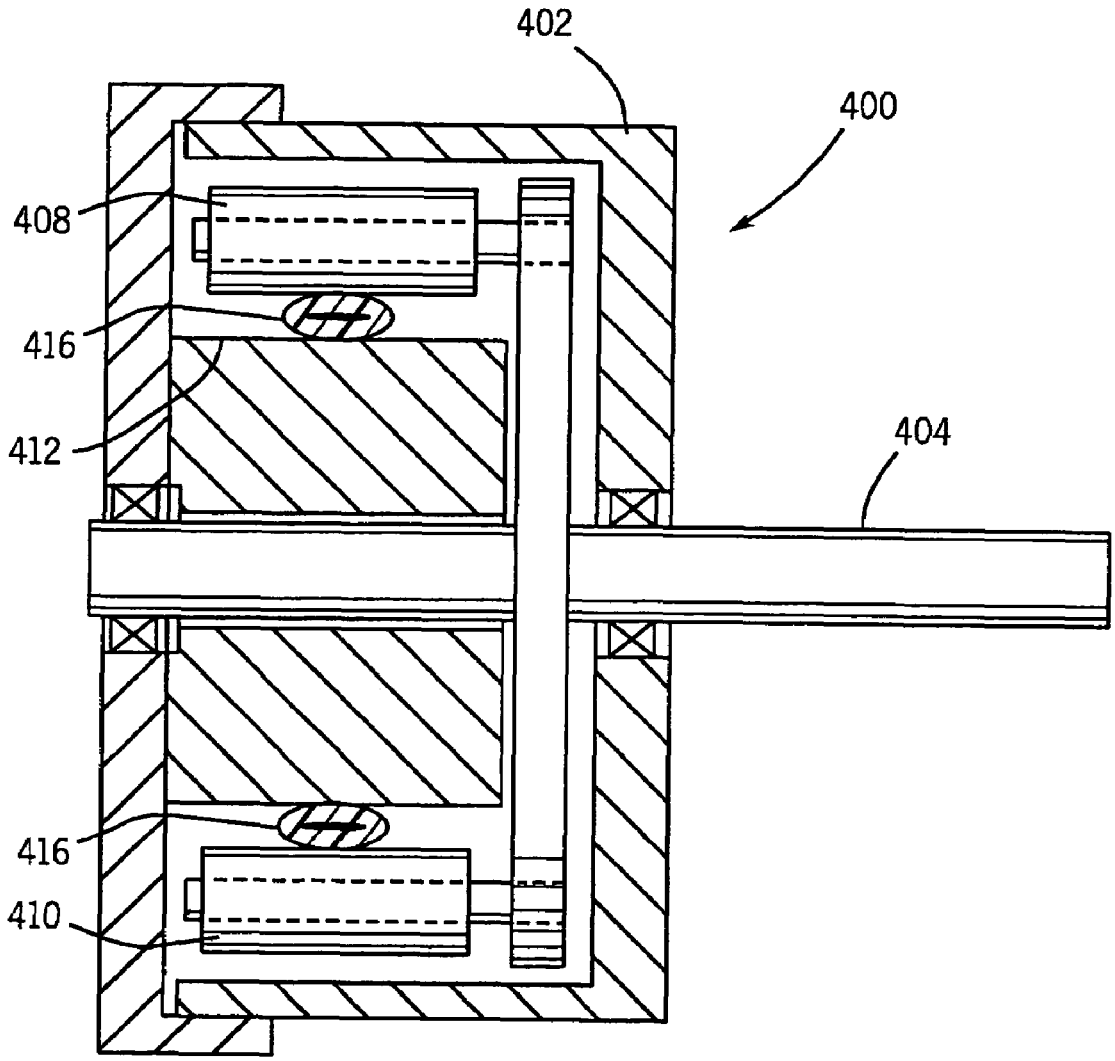
FIG. 20 illustrates a peristaltic pump where the rollers are positioned radially outwardly from the pump tube.
Figure 21:
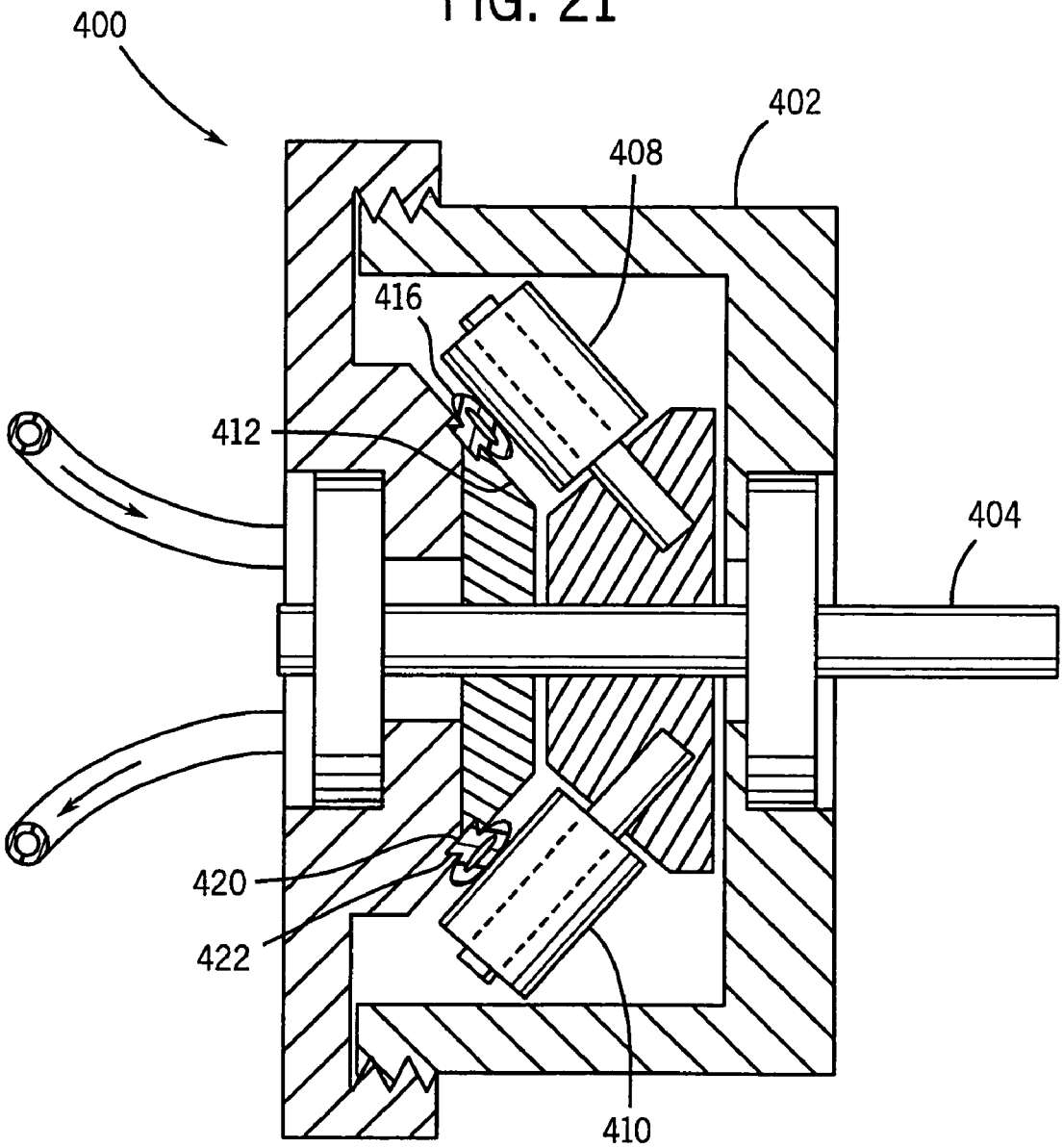
FIG. 21 illustrates a peristaltic pump where the rollers are positioned radially outwardly from the pump tube and are angled inwardly toward the center of the pump housing.

FIGS. 20 and 21 show a cutaway view of a peristaltic pump 400 having a pump housing 402 and a drive shaft 404 used to rotate occluding members 408 and 410. As can be seen in FIGS. 20 and 21, the pump tube 416 is positioned between the pump tube track 412 and the occluding members 408 and 410 with the occluding members positioned radially outwardly from the pump tube. FIG. 21 shows a cutaway view of a peristaltic pump where the pump tube track 412 is angled outwardly from the center of the pump housing to allow for easier pump tube loading. The pump tube 416 includes a dovetail or tang 420 that is adapted to be received in a groove 422 positioned in the pump tube track 412 to maintain the pump tube 416 along the pump tube track 412. In this example, the occluding members 408 and 410 are angled inwardly towards the center of the pump housing to engage the pump tube 416. While FIGS. 20 and 21 show two occluding members, it will be appreciated that this embodiment would work with one or more occluding members and is not limited to the use of two occluding members.

Figure 22A:
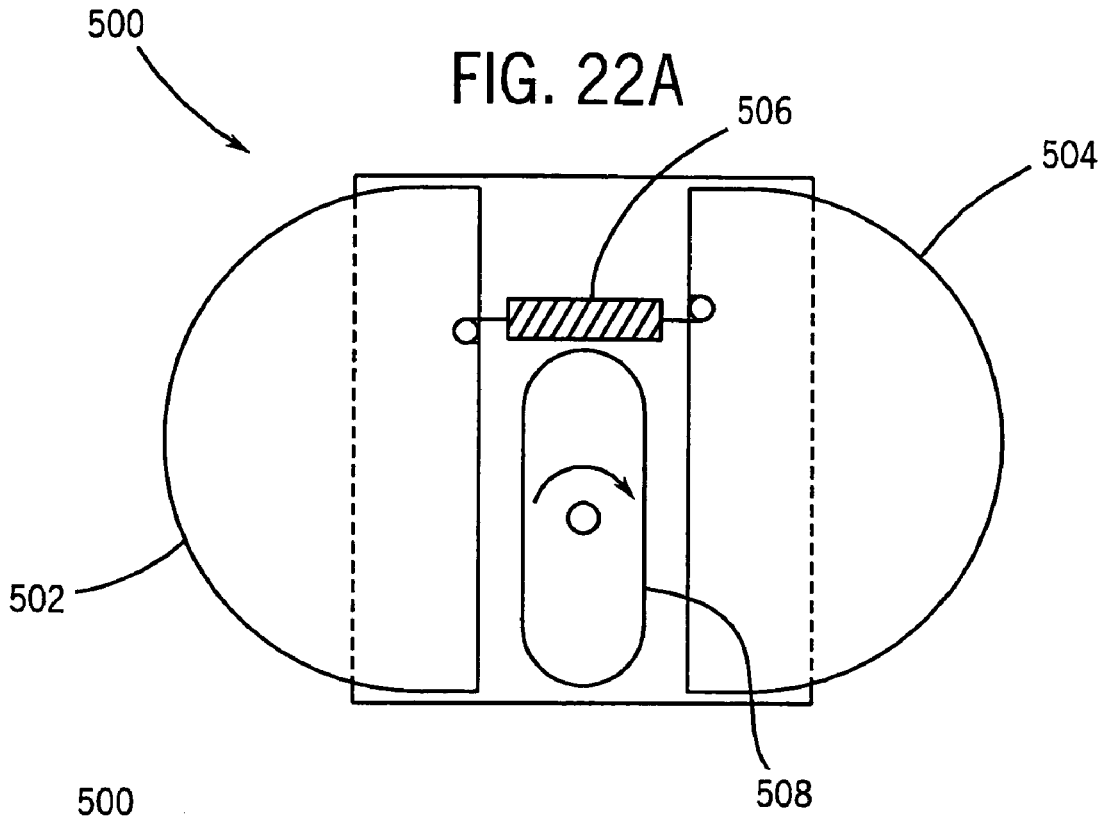
FIG. 22*a-b* illustrate an adjustable pump tube track that could be used with the pump shown in FIG. 20 in order to allow the tube to be loaded easily.
Figure 22B:
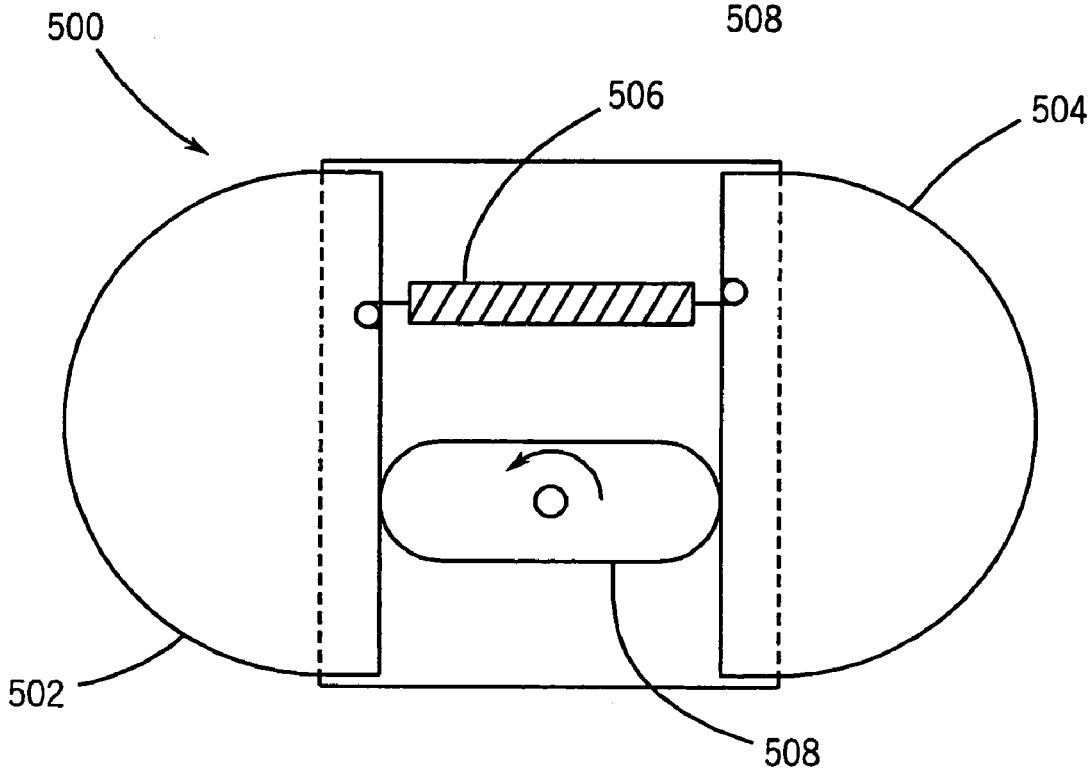

FIGS. 22*a-b* shows an adjustable pump tube track 500 that could be used in the pump housing shown in FIG. 20 where the pump tube track is located radially inwardly from the occluding members. The adjustable pump tube track comprises a first half 502 and a second half 504 and a spring 506 connected to both halves 502, 504 that biases the first half 502 towards the second half 504. A cam 508 is provided between the first half 502 and the second half 504 that is rotatable to force the first half away from the second half. A pump tube may be placed onto the pump tube track when the first and second halves are in the position shown in FIG. 22*a*, and then the pump tube track is expanded as shown in FIG. 22*b* to tightly position the pump tube against the pump tube track. This arrangement eliminates the need to provide a pump tube having a dovetail or tang.

In view of the wide variety of embodiments to which the principles of the present embodiments can be applied, it should be understood that the illustrated embodiments are exemplary only, and should not be taken as limiting the scope of the present invention. Thus, the claims should not be read as limited to the described order or elements unless stated to that effect. All embodiments that come within the scope and spirit of the following claims and equivalents thereto are claimed as the invention.

The invention claimed is:

1. A peristaltic pump comprising:

a pump housing having an inlet and an outlet; and a compressible pump tube having a fluid inlet end and a fluid outlet end, and positioned within the pump housing; and two or more occluding members rotatably mounted within the pump housing; and a pump tube track positioned within the housing; and where the pump tube is positioned along the pump tube track between the two or more occluding members and the pump tube track so that the occluding members occlude the pump tube during rotation and provide a flow of fluid through the pump tube; and the inlet end of the pump tube has a first constant internal diameter D extending to a position inside the pump housing where the pump tube then tapers down to a second constant internal diameter d, where the tapering occurs such that when the second occluding member rotates onto the second constant internal diameter d portion of the pump tube, the first occluding member continues to occlude a portion of the second constant internal diameter d, wherein when the first occluding member exits occlusion of the pump tube, a volume of compensating fluid is transported in the direction of first occluding member to compensate for a void created when the first occluding member exits occlusion; wherein the constant diameter d portion of the pump tube begins at a position just over 90 degrees within the pump tube housing.

2. The peristaltic pump of claim 1, wherein when a first occluding member occludes the pump tube within the pump housing a second occluding member upstream from the first occluding member occludes the tapered diameter portion of the pump tube.

3. The peristaltic pump of claim 2, wherein when the second occluding member rotates onto the second constant diameter d portion of the pump tube, the first occluding member continues to occlude the pump tube having constant diameter d, such that a greater volume and pressure of fluid is contained within the pump tube between the first and second occluding members than would exist if the entire pump tube were of a constant internal diameter.

4. The peristaltic pump of claim 1, further including a third occluding member where each of the occluding members are spaced 120 degrees from each other.

* * * * *